US006657595B1

(12) United States Patent
Phillips et al.

(10) Patent No.: US 6,657,595 B1
(45) Date of Patent: Dec. 2, 2003

(54) SENSOR-DRIVEN ADAPTIVE COUNTERPOISE ANTENNA SYSTEM

(75) Inventors: James P. Phillips, Lake in the Hills, IL (US); Eric L. Krenz, Crystal Lake, IL (US); Andrew A. Efanov, Crystal Lake, IL (US); Rachid M. Alameh, Crystal Lake, IL (US); Roger L. Scheer, Crystal Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/142,173

(22) Filed: May 9, 2002

(51) Int. Cl.[7] ..... H01Q 1/24
(52) U.S. Cl. ..... 343/702; 343/846; 343/895
(58) Field of Search ..... 343/702, 790, 343/841, 846, 847, 848, 895

(56) References Cited

U.S. PATENT DOCUMENTS 4,138,681 A 2/1979 Davidson et al.
4,523,155 A 6/1985 Walczak et al.
4,633,519 A 12/1986 Gotoh et al.
4,700,197 A 10/1987 Milne
4,814,776 A 3/1989 Caci et al.
4,868,576 A 9/1989 Johnson, Jr.
5,109,544 A 4/1992 Mittel et al.
5,446,922 A 8/1995 Siwiak et al.
5,634,203 A 5/1997 Ghaem
6,081,700 A 6/2000 Salvi et al.
6,421,016 B1 * 7/2002 Phillips et al. ..... 343/702

* cited by examiner

*Primary Examiner*—Don Wong
*Assistant Examiner*—Shih-Chao Chen
(74) *Attorney, Agent, or Firm*—Brian M. Mancini

(57) ABSTRACT

An adaptive antenna system having a counterpoise conductor contained within a housing of a communication device and located distally from such surfaces of the housing that can be held by or placed in proximity to a user or external objects which detune the counterpoise. A tuning circuit is coupled between the counterpoise conductor and a ground. The tuning circuit is operable to adapt the resonant frequency of the counterpoise conductor to divert operational RF currents away from the ground located in proximity the user or external objects and onto the counterpoise conductor.

20 Claims, 5 Drawing Sheets

10

FIG. 7

| PHONE USAGE STATE | SENSOR CONDITION | | | DESIRED ACTION | DESIRED DEFAULT STATE |
|---|---|---|---|---|---|
| | ACTIVE | NOT ACTIVE | DON'T CARE | | |
| TALK POSITION AT EAR | FU OR FL, LU OR LL, RU OR RL, | BU,BL | IF,IB | ADAPT CURRENT TO BACK OF PHONE | SET MAX POWER LIMITS LOW IF ADAPT FAILS |
| SHIRT POCKET FACING IN | FU OR FL | BU,BL LU,LL RU,RL | IF,IB | ADAPT CURRENT TO BACK OF PHONE | SET MAX POWER LIMITS LOW IF ADAPT FAILS |
| SHIRT POCKET FACING OUT | BU OR BL | FU,FL LU,LL RU,RL | IF,IB | ADAPT CURRENT TO FRONT OF PHONE | SET MAX POWER LIMITS LOW IF ADAPT FAILS |
| BELT CLIP FACING IN | FU OR FL | BU,BL LU,LL RU,RL | IF,IB | ADAPT CURRENT TO BACK OF PHONE | SET MAX POWER LIMITS LOW IF ADAPT FAILS |
| BELT CLIP FACING OUT | BU OR BL | FU,FL LU,LL RU,RL | IF,IB | ADAPT CURRENT TO FRONT OF PHONE | SET MAX POWER LIMITS LOW IF ADAPT FAILS |
| CONDUCTIVE TABLE TOP FACING UP | BU OR BL | FU,FL LU,LL RU,RL | IF,IB | ADAPT CURRENT TO FRONT OF PHONE | SET MAX POWER LIMITS LOW IF ADAPT FAILS |
| CONDUCTIVE TABLE TOP FACING DOWN | FU OR FL | BU,BL LU,LL RU,RL | IF,IB | ADAPT CURRENT TO BACK OF PHONE | SET MAX POWER LIMITS LOW IF ADAPT FAILS |
| NON-CONDUCTIVE TABLE TOP FACING UP | IB | IF,FU,FL BU,BL LU,LL RU,RL | | ADAPT CURRENT TO FRONT OF PHONE | SET MAX POWER LIMITS HIGH IF ADAPT FAILS |
| NON-CONDUCTIVE TABLE TOP FACING DOWN | IF | IB,FU,FL BU,BL,LU, LL, RU,RL | | ADAPT CURRENT TO BACK OF PHONE | SET MAX POWER LIMITS HIGH IF ADAPT FAILS |
| PDA/DIALING USAGE IN HAND | BL,LL,RL | FL,FU | IF,IB | ADAPT CURRENT TO FRONT OF PHONE | SET MAX POWER LIMITS HIGH IF ADAPT FAILS |
| HARD-DETECTED "BAD HANDS" | FU OR FL, BU,BL,LU, LL,RU,RL | | IF,IB | ADAPT CURRENT TO BACK OF PHONE AND NOTIFY USER TO MOVE HAND | SET MAX POWER LIMITS LOW IF ADAPT FAILS |
| FREE SPACE | | IF,IB,FU FL,BU BL,LU,LL RU,RL | | ADAPT CURRENT TO BOTH FRONT & BACK OF PHONE | SET MAX POWER LIMITS HIGH IF ADAPT FAILS |

SENSOR-DRIVEN ADAPTIVE COUNTERPOISE ANTENNA SYSTEM

FIELD OF THE INVENTION

The present invention relates generally to radio antennas, and more particularly to an antenna for portable communication devices.

BACKGROUND OF THE INVENTION

Wireless handheld communication devices, such as cellular telephones, transmit RF power and are carefully scrutinized for their level of RF radiation emissions. The highest level of RF exposure is most often from RF currents flowing on or in the conductive parts of the housing of the device and not on the antenna. Prior art methods of reducing or eliminating the RF currents of the housing have resulted in the use of large and unwieldy antennas or large RF currents that cause large reactive near fields of the antenna such that it then becomes the dominant source of RF emission. In either case, the size of the antenna and phone increases.

The size of portable communication devices has historically been set by the size of the enclosed electronics and the battery. Consumer and user demand has continued to push a dramatic reduction in the size of communication devices. As a result, during transmission, the antenna induces higher RF current densities onto the small housing, chassis or printed circuit boards of the communication device in an uncontrolled manner. These RF currents are often dissipated rather than efficiently contributing to the radiation of RF communication signals. The dissipation of RF power can detrimentally affect the circuitry on very small units. Moreover, this loss of power lowers the quality of communication and reduces battery life of the device.

Another problem experienced by prior art antennas is the radiation degradation experienced when the portable radio is held and used by the operator. Continuous advances in electronics and battery technology have allowed a dramatic reduction in size, so much so that the performance of the antenna is poor due to it being enclosed by a user's hand.

The metallic portion of the housing of the portable radio is typically used as the ground or counterpoise for the antenna and allows RF currents to flow in an uncontrolled manner. Unacceptable radiation degradation is typically experienced when an operator places their hand around the housing, thereby causing degradation in the radiation efficiency of the ground radiator.

Accordingly, what is needed is a communication device having a controlled flow of RF currents within the housing of the device so as to remove them from the proximity of the user. It would also be beneficial to provide the capability to adapt current flow to the antenna to improve efficiency. Additionally, it would be an advantage to accomplish these needs without radiation degradation, decreased battery life, or increased size or cost of the communication device.

BRIEF DESCRIPTION OF THE DRAWINGS

FIG. 7 is a table of possible proximity sensor conditions and responses, in accordance with the present invention.

DETAILED DESCRIPTION OF THE PREFERRED EMBODIMENTS

Figure 1:
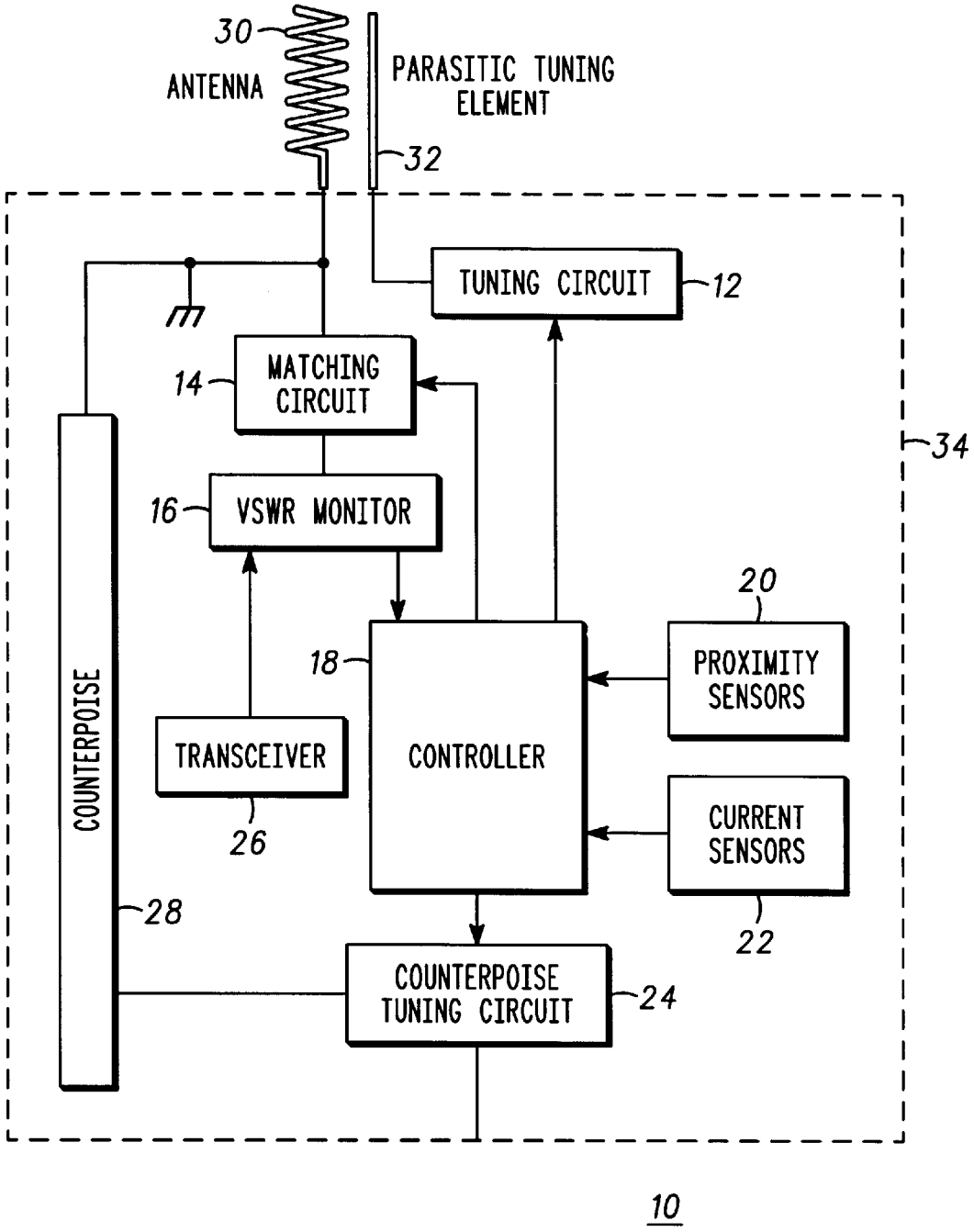
FIG. 1 is a simplified block diagram of an antenna system of a communication device, in accordance with the present invention.

The present invention provides a radio communication device configured to control the flow of RF currents within a housing of the device so as to remove them from the proximity of the user. In particular, a counterpoise conductor is used to act as a current sink to counterbalance currents on the phone case by adding an internal conductor that is more attractive to the induced currents. The currents on the counterpoise are located in a smaller, more favorably located area on the phone. This results in a reduction in the near field strength on the face of the phone without inhibiting transmit efficiency. In addition, the present invention can improve antenna efficiency by channeling more of the RF current to the intended antenna system and away from those portions of the chassis or housing that are proximate to the user, thereby increasing battery life, without increased size or cost of the communication device.

As portable communication technology has advanced, antenna efficiency and electromagnetic exposure have become issues in two-way (transmit) hand-held wireless communication products. Smaller, hand-held, wireless communication products are demanded by the market and meeting antenna efficiency and electromagnetic exposure requirements are more difficult. The present invention provides an adaptive antenna system to control near field radiation without inhibiting far field radiation efficiency. This invention combines the concept of using a counterpoise with a novel control system concept and an optional tunable antenna to allow the resonant frequencies of the counterpoise and antenna to be adaptively tuned in response to sensor input. Sensitivity and bandwidth issues encountered with counterpoise designs are overcome though the novel use of a tuning circuit between the counterpoise and ground. Preferably, counterpoise tuning is driven by sensor input collected for ground current distribution (RF currents on the conductive structure of the device) and user proximity, and control of the tunable antenna is driven by antenna VSWR sensor input.

The addition of a counterpoise to a mobile phone is known in the art and has been shown to accomplish a benefit to RF efficiency within a selected band of frequencies. One major obstacle to the use of counterpoises is their susceptibility to detuning affects whenever the phone is positioned close to the user's face or hand. The present invention supplements a counterpoise with tuning circuitry to provide the capability to adjust the resonant frequency of the counterpoise and adapt for detuning affects. The addition of a tunable antenna further enhances the adaptability of the system by allowing the antenna to adjust to changes caused by counterpoise tuning and to changes in the external RF environment. The tuning circuitry for the counterpoise and the antenna are driven by the ability of the phone to sense the user's position, antenna's efficiency, and ground currents, such as can be found on a conductive housing or circuit boards of the device. Advantageously, this capability also broadens the usable bandwidth of the antenna system, alleviating the bandwidth narrowing affect of a high Q counterpoise.

The invention will have application apart from the preferred embodiments described herein, and the description is provided merely to illustrate and describe the invention and it should in no way be taken as limiting of the invention. While the specification concludes with claims defining the features of the invention that are regarded as novel, it is believed that the invention will be better understood from a consideration of the following description in conjunction with the drawing figures, in which like reference numerals are carried forward. As defined in the invention, a radiotelephone is a communication device that communicates information to a base station using electromagnetic waves in the radio frequency range. In general, the radiotelephone is portable and, when used, is typically held up to a person's head, next to their ear.

The concept of the present invention can be advantageously used on any electronic product requiring the transceiving of RF signals. Preferably, the radiotelephone portion of the communication device is a cellular radiotelephone adapted for personal communication, but may also be a pager, cordless radiotelephone, or a personal communication service (PCS) radiotelephone. The radiotelephone portion may be constructed in accordance with an analog communication standard or a digital communication standard. The radiotelephone portion generally includes a radio frequency (RF) transmitter, a RF receiver, a controller, an antenna, a battery, a duplex filter, a frequency synthesizer, a signal processor, and a user interface including at least one of a keypad, display, control switches, and a microphone. The radiotelephone portion can also include a paging receiver. The electronics incorporated into a cellular phone, two-way radio or selective radio receiver, such as a pager, are well known in the art, and can be incorporated into the communication device of the present invention.

FIG. 1 illustrates a communication device according to the present invention. By way of example only, the communication device is embodied in a cellular radiotelephone having a conventional cellular radio transceiver circuitry, as is known in the art, and will not be presented here for simplicity. The cellular telephone, includes conventional cellular phone hardware (also not represented for simplicity) such as user interfaces that are integrated in a compact housing, and further includes an antenna system, in accordance with the present invention. Each particular wireless device will offer opportunities for implementing this concept and the means selected for each application.

FIG. 1 is a simplified block diagram of the adaptive antenna system, in accordance with the present invention. In a first embodiment, the antenna system is configured for a communication device 10 having a transceiver 26 disposed within a housing 34. The housing 34 can be an insulator such as plastic, but it typically is a conductor or contains a conductor that acts as a ground plane for the antenna. Internal printed circuit boards can act as ground planes. An antenna element 30 is electrically coupled to the transceiver 26 of the device 10. In a typical application, the antenna element 30 extends outwardly from the housing 34 and is electrically coupled to transceiver circuitry 26 of the device 10. However, the antenna can also be completely contained within the housing. The transceiver 26 operates in any of the well known modes of operation for radio transceivers. At least one conductor 28 is configured as a counterpoise to the antenna 30 and is connected to ground at one end. The counterpoise conductor 28 can be located anywhere in or on the communication device, but is preferably contained within the housing 34 and is located distally from such surfaces of the housing 34 that can be held by or placed in proximity to a user. A second conductor 34 is coupled to a ground connection of the antenna and is contained within the housing. In its simplest form the second conductor is a portion of the housing (as shown), but it can also take the form of printed circuit board traces or other electrically conductive portions of the device 10.

A counterpoise tuning circuit 24 is coupled between the at least one counterpoise conductor 28 and the second conductor 34. The tuning circuit 24 is operable to adapt the resonant frequency of the at least one counterpoise conductor 28 to attract operational RF currents onto the at least one counterpoise conductor 28 and divert operational RF currents away from the second conductor 34. In the instance where the housing 34 is the second conductor, the tuning circuit 24 adapts the counterpoise conductor to draw RF currents away from the housing 34 and subsequently the user. Further, having the device and housing in proximity to a user's hand or near an external object, for example, detunes the antenna. The tuning circuit adapts the resonant frequency of the counterpoise conductor in response to detuning effects caused by location of the device in proximity to the user.

Tuning is accomplished by including tuning impedances (reactive and/or resistive devices) that are either added or incorporated into the radio's RF chassis and/or conductive parts of the communication device 10, which "steer" RF currents by either attracting them with a low impedance or repelling them with a high impedance. Since resistive devices dissipate RF power, the most power efficient approach is to use reactive devices that are either capacitive or inductive. Actual or artificial transmission line devices can be used for the counterpoise, and a quarter-wavelength resonator is the most useful.

Figure 3:
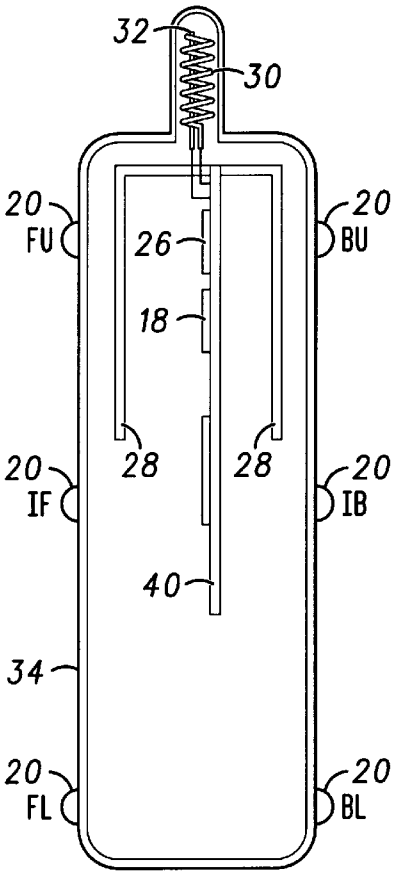
FIG. 3 is a cross-sectional side view of the communication device of FIG. 2.
Figure 2:
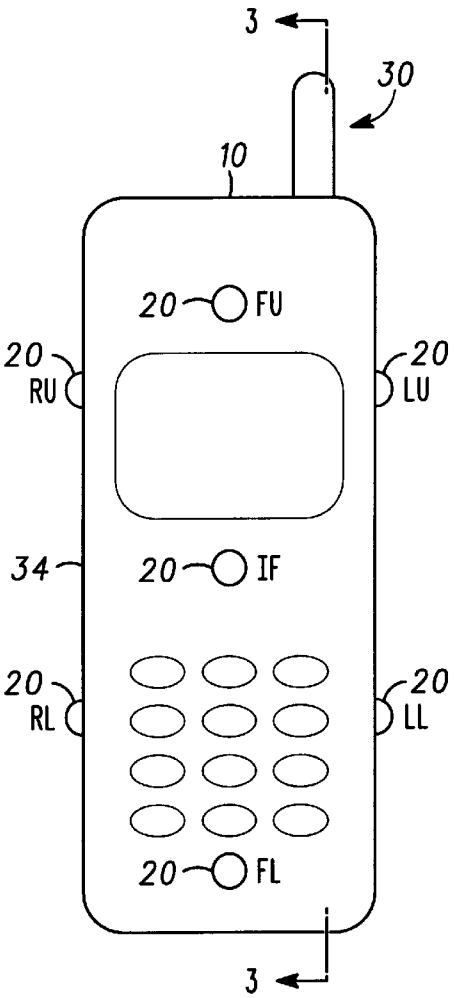
FIG. 2 is a front view of a communication device incorporating proximity sensors, in accordance with the present invention.

In a preferred embodiment, the device 10 includes a controller 18. The controller can be a separate processor or can use an existing processor within the device inasmuch as the adaptive tuning need only be performed occasionally, such as during power control portions of a communication. The controller 18 controls the operation of the counterpoise tuning circuit 24 in response to inputs indicating the proximity of the user. In particular, the inputs indicating user proximity are supplied by a plurality of proximity sensors 20 disposed on the housing 34, as shown in FIGS. 2 and 3. The controller 18 uses these input signals to electronically tune the tuning circuit 24. The proximity sensors 20 are operable to detect a proximity of the device to external objects, such as a position of the device 10 relative to the user's body for example, and provide a signal for the tuning circuit 24 to direct currents away from that portion of the second conductor 34 near the activated proximity sensors and onto a counterpoise conductor 28.

In practice, a combination of capacitive and infrared proximity sensors can be used. A capacitive sensor is activated when a nominally conductive material (such as a user's finger, but not the material in clothing) is brought near it. Alternatively, a pressure sensor can be used. An IR sensor is activated (blocked) by proximity of any material that scatters IR. Capacitive sensors can discriminate between skin and clothing and are placed on the face, and back of the phone housing (FU,BU,FL,BL in FIGS. 2 and 3). Capacitive sensors are also located on each side of the phone (RU,LU, RL,LL) to provide hand-positioning information. IR sensors (IF,IB) are able to sense the proximity of an object but cannot discriminate between sensing a person's hand, the inside of a purse, or a belt clip. The combination of capacitive and IR sensors allows reliable detection of objects as well as discrimination between people and inanimate objects. The range for the state of the art in capacitive and IR sensors easily satisfies the distances of 1 to 7 mm that is typical for this application.

More preferably, the present invention includes at least one current sensor 22 disposed in proximity to the second conductor 34, housing or ground plane 40 to the antenna element 30 to detect the radio frequency (RF) currents flowing on particular portions of the second conductor 34, such as the ground plane 40 of a printed circuit board, conductive portions of the radiotelephone chassis, or the device housing. The current sensor is operable to detect and monitor current in the second conductor 34, device housing or ground plane 40 and provide a signal for the tuning circuit 24 to direct the detected current away from the second conductor 34 housing or ground plane 40. In particular, the current sensor 22 can provide a signal to the controller 18 to direct the tuning circuit 24 to direct currents accordingly. Optionally, a current sensor can be disposed on the counterpoise 28 to detect currents thereon. In this case, the current sensor is operable to detect and monitor current in the counterpoise 28 and provide a signal for the tuning circuit 24 to confirm the detected current onto the counterpoise 28. In particular, current sensors can be provided on the second conductor 34 and the counterpoise 28 to provide a signal to the controller 18 to direct the tuning circuit 24 to direct currents accordingly.

Figure 4:
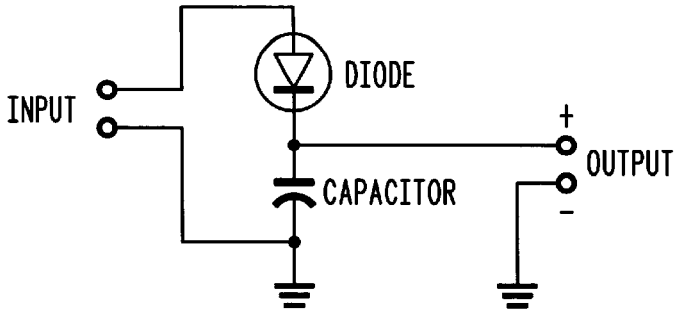
FIG. 4 is a schematic diagram of a current sensor circuit.
Figure 5:
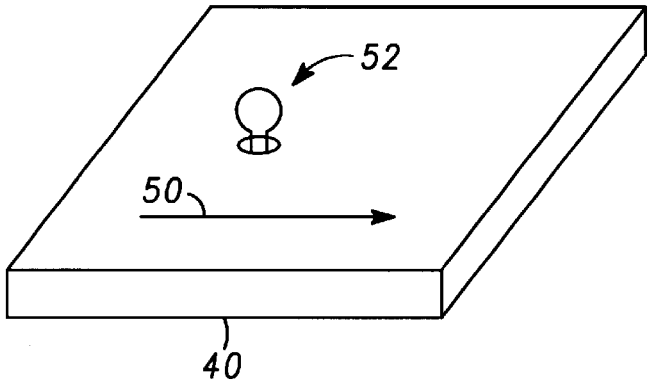
FIG. 5 is a perspective view of a first embodiment of a current sensor.

The output of these current sensors is a voltage that is proportional to the magnitude of the RF current flowing in the vicinity of the sensor. Two general implementations are envisioned. Each uses a diode that acts as a half wave rectifier in a circuit as shown in FIG. 4. The first and preferred implementation uses a loop probe 52 as shown in FIG. 5. The use of loops is known to detect the magnetic field generated by RF current 50 flowing on metallic structures, such as a ground plane 40. In this application, the loop 52 can be mounted directly on the printed circuit board 40, housing 34, or even the at least one counterpoise conductor 28. The loop 52 is orientated in such a manner as to detect RF current 50 flowing in the direction that contains the plane of the loop 52 (when the loop is mounted perpendicular to the structure on which the RF current is flowing). The magnetic field resulting from the RF current 50 passes through the loop area 54 inducing a RF voltage across the loop terminals. The RF voltage produced in the loop is in turn provided to the diode detection circuit of FIG. 4.

Figure 6:
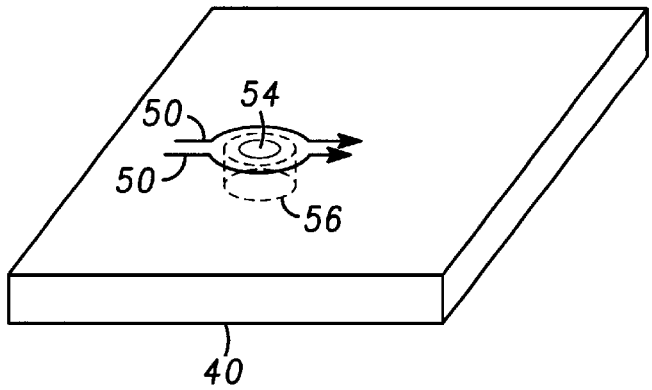
FIG. 6 is a perspective view of a second embodiment of a current sensor.

An alternate implementation to detect RF current is shown in FIG. 6 and employs an aperture 54 (region of non-metal) placed in the desired location. The aperture 54 in the conductive surface forces the RF current 50 to move around the aperture 54 thereby generating a voltage across the aperture 54. The aperture 54 is backed by a cavity 56 so that voltage is the result of RF current flowing on the side of the opposite of that of the cavity. This RF voltage can be detected by the diode circuit of FIG. 4. Any other technique of current detection can be used to advantage in the present invention, in the same manner as described.

In practice, the proximity sensors and current sensors are used in tandem. Coarse tuning of the counterpoise conductor is driven by input from the proximity sensors on the housing of the phone that defines the position of the phone relative to the user. Input from the current sensors allow the controller to fine tune the counterpoise as slight changes in the proximity between the user and the phone cause detuning of the counterpoise. Handling of all the inputs from the sensors and control of the tuning circuit can require a considerable amount of processing. These inputs originate in an analog manner, but preferably are converted and processed as digital signals, using known techniques. Rather than having the radiotelephone main processor handle this processing, some processing can be accomplished in a processor closer to the sensors to reduce the required number of input/output control lines and data processing load. The tradeoff would be the increase in the cost of adding the counterpoise system with significant processing capabilities at the sensors. The radiotelephone main processor could be used for all sensor/tuning control if the processing burden is not severe.

Sensor data rates should not be extremely high since user positioning is a fairly slow process compared to electronic timing. Polling rates of the order of five to ten times per second is sufficient. The number of sensors may be large enough that some processing will need to be distributed in order to reduce the number of I/O lines required. This can be accomplished by incorporating more processing into the sensors or by locating dedicated processors closer to the sensors. Distributed processing could be needed to condense multiple sensor inputs onto one or two data lines to the main processor. Similarly, control needs for the antenna and counterpoise system can be significant. In practice, the variably tuned circuits will require separate control lines. Tuning circuitry for the counterpoise will need to be controlled separately from the antenna's tunable circuitry. Attracting ground currents from the housing will require tuning that is specific to the counterpoise only. Having multiple counterpoise conductors will require further control lines.

Preferably, more than one counterpoise conductor 28 can be used (as shown in FIG. 3) to allow for shifting between counterpoises as the position of the phone relative to the body changes. Beneficially, a multiple counterpoise system can also be used to provide for tuning corrections in multiband operation, i.e. where the antenna element is operable in more then one frequency, multiple counterpoises are provided for each of the frequencies.

In a preferred mode of operation, using multiple counterpoises, if the front proximity sensors (FU,FL,IF) are activated then housing currents are directed towards a counterpoise conductor located at the back of the radiotelephone, away from those activated sensors. Referring to FIG. 7, this can occur if the phone is at a user's ear, in a shirt pocket facing in, in a belt clip facing in, on a table facing down, etc. Conversely, if the back proximity sensors (BU,BL,IB) are activated then housing currents are directed towards a counterpoise conductor located at the front of the radiotelephone, away from those activated sensors. This can occur if the phone is in a shirt pocket facing out, in a belt clip facing out, on a table facing up, dialing while in a user's hand, etc. The same can be said of the use of current sensors. If no sensors are activated currents can be draw to either or all of the counterpoises. If all sensors are activated, then current can be drawn to the rear counterpoise in the assumption that the front of the phone is proximal to a user's head.

Still more preferably, the present invention includes the antenna element 30 being tunable. Referring back to FIG. 1, this can be accomplished by a parasitic element 32. Several effects can change the antenna tuning. Among these are counterpoise conductor tuning, antenna efficiency, user proximity, RF ground currents, the external RF environment, and the like. Antenna tuning is accomplished by coordinating the antenna tuning and matching circuit 14 to create an optimal impedance match for the antenna element 30 at the desired operating frequency. The controller 18 can drive the antenna network to preset tuning loads based on changing channel frequencies. In addition, the controller 18 can control a tuning circuit 12 to drive a parasitic tuning element 32 to change the frequency characteristics of the antenna element 30. In either case, adaptive tuning of the antenna is driven by feedback data received from the VSWR monitor (16 in FIG. 1), which provides the controller 18 with information about how well the antenna is tuned to a desired frequency. In particular, VSWR monitor 16 is used to determine a mismatch between the transmitter output and the RF load. The VSWR monitor measures actual forward and reflected RF power in order to calculate VSWR. It can incorporate a 4-port directional coupler, with the main line input and output ports being connected to the transmitter's output and its RF load, respectively. Both coupled ports of the coupler are connected to corresponding RF power sensors, which provide data about measured forward and reflected RF power levels. This data is received by the controller 18, which retrieves actual VSWR. The above described antenna element tuning capability also broadens the usable bandwidth of the antenna system, combating the bandwidth narrowing affect of the high Q counterpoise.

Perturbations in the antenna element's resonant frequency, due to shifts in counterpoise tuning are sensed and corrected independently. Tuning adjustments to the matching circuit will need to be autonomous to ensure smooth and efficient tracking of antenna efficiency versus ground current suppression. The antenna matching circuit 14 may also require the capability to tune independently of the antenna tuning circuitry 12 as it is anticipated that the matching circuit will not need to be re-tuned for small adjustments in the antenna's resonant frequency. Also, the matching circuit needs to be able to tune independently to solve for disparities identified in VSWR measurements. Corrections by the matching circuit could be to increase efficiency by improving the VSWR or could be to increase the VSWR and lower efficiency to decrease SAR.

In operation, the adaptive tuning system of the present invention is an overlay to existing power step algorithms used in radiotelephones. The system establishes an Enhanced Power Mode (EPM) and a Standard Power Mode (SPM) for critical power amplifier steps. The Enhanced Power Mode sets higher maximum power levels for the upper-level power steps. The Standard Power Mode is the default mode and will be reverted to for lower power steps that produce negligible housing currents or if there is a failure in tuning. Power levels for each power step in Standard Power Mode will be phased so that the phone maintains lower output without the aid of counterpoise tuning. The adaptive tuning system will also enhance RF efficiency at the mid-level power steps. If the ability to tune fails, the present invention will then set lower maximum power limits (SPM) where the sensors indicate there is probable exposure to a user, and higher maximum power limits (EPM) where the sensors indicate there is no near-field exposure to a user. FIG. 7 shows a table of tuning actions and default power levels which depend on activation of proximity sensors (although current sensors can also be included), with reference to FIGS. 2 and 3.

Multiple alternative embodiments of this invention are envisioned that utilize portions of the entire adaptive tuning system shown in FIG. 1. For example, antenna element tuning could be separated from the counterpoise element tuning to facilitate RF tuning whenever housing (second conductor) currents are below a predetermined threshold for allowing counterpoise tuning. This would enhance the RF efficiency, increase call quality, and lower power consumption at the lower transmitter power steps. In addition, proximity sensor data can be used independently of the tuning system to generate suggestions for the user regarding suggestions for re-positioning the phone to increase RF efficiency. Another alternative embodiment can be conceived that separates the antenna and counterpoise tuning functions to allow tuning of multiple counterpoises with or without adaptive tuning of the antenna element.

Phone configurations that physically utilize only parts this invention can also be easily conceived. For example, if the bandwidth of the antenna is not an issue, the sensor and tunable counterpoise systems could be implemented with a traditional (non-tunable) handset antenna to reduce the near-field strengths.

An additional group of alternative embodiments can be conceived based on the concept of adaptive tuning of the received signal. The addition of an adaptive tuning capability using the received signal could be valuable on TDD systems, where transmit and receive protocols share the same frequency, or for FDD systems with antennas designed with constant separations between the transmit and receive patterns. In this instance the receive signal could also be used to tune or pre-tune the adaptive system during periods of inactivity for the transmitter. Receive channel tuning could also be extended to versions of this invention for passive handheld devices such as pagers.

Figure 8:
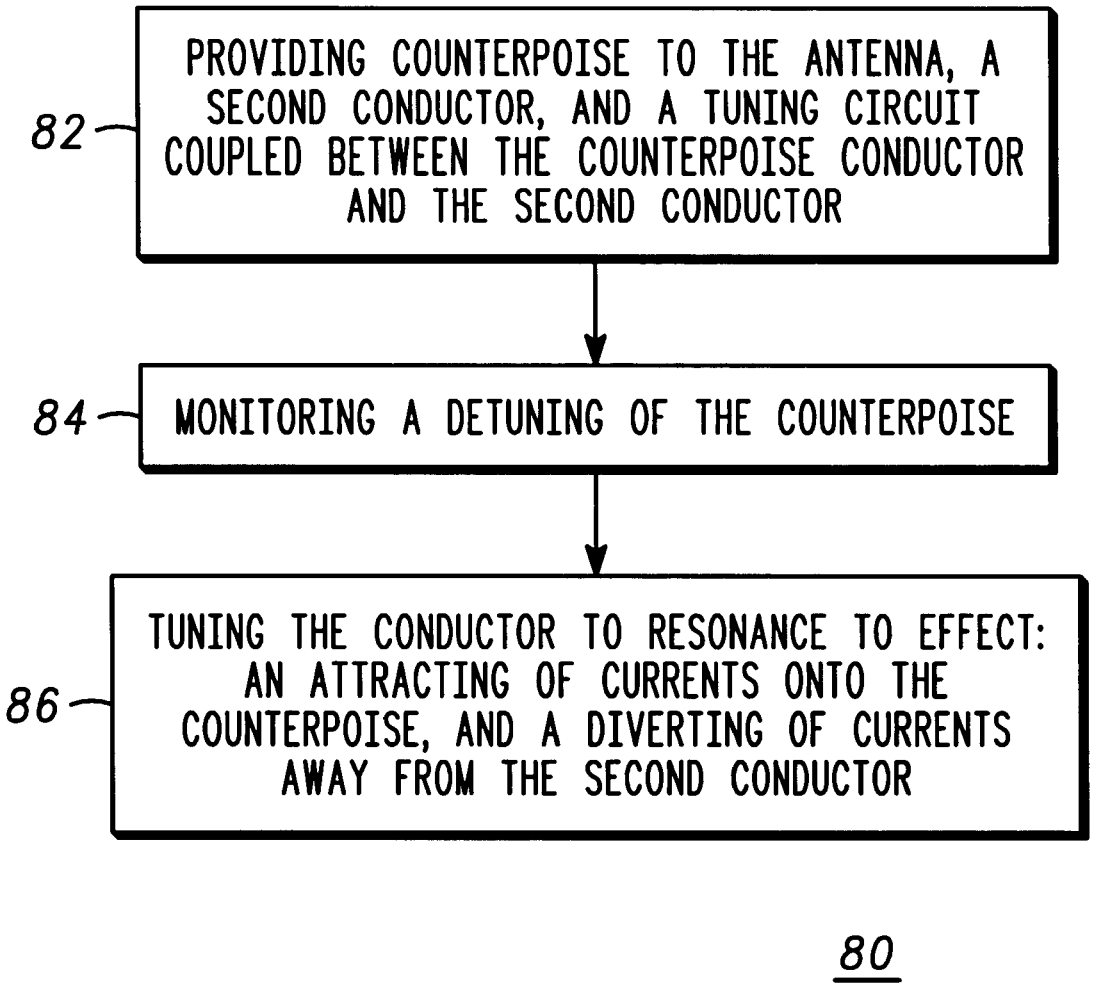
FIG. 8 is a flow chart of a method for adaptive tuning, in accordance with the present invention.

The present invention also incorporates a method for antenna counterpoise tuning. FIG. 8 demonstrates a first embodiment of the method 80 for use for an antenna system in a communication device with a housing. A first step 82 includes providing at least one conductor counterpoise to the antenna, a second conductor contained within the housing, and a tuning circuit coupled between the counterpoise conductor and the second conductor. A next step 84 includes monitoring a detuning of the counterpoise conductor. A next step includes tuning 86 the at least one counterpoise conductor to resonance to effect: an attracting of operational RF currents onto the at least one counterpoise conductor, and a diverting of operational RF currents away from the second conductor.

In practice, the providing step 82 includes a portion of the housing being a conductive ground plane and constituting the second conductor, and the at least one counterpoise conductor is internal to the housing such that the tuning step 86 adapts the counterpoise conductor to draw RF currents away from the housing and subsequently a user. Moreover, the monitoring step 84 includes monitoring of the a least one counterpoise conductor in response to detuning effects caused by location of the device in proximity to an external object or a user.

In a preferred embodiment, the providing step 82 includes providing a plurality of proximity sensors disposed on the housing, and wherein the monitoring step 84 includes the proximity sensors detecting a proximity of the device to external objects or a user and providing a signal for the tuning step 86 to direct currents away from that portion of the second conductor near the activated proximity sensors. In practice, it is advantageous for the providing step 82 to include providing a controller to control the operation of the tuning step 86 in response to inputs from the monitoring step 84.

Optionally, the providing step 82 can include providing at least one current sensor disposed in proximity to the second conductor. The monitoring step 84 can include the at least one current sensor detecting current in the second conductor and outputting a signal for the tuning step 86 to direct the detected current away from the second conductor.

Preferably, the proximity and current sensor work in tandem as previously described.

More preferably, the providing step 82 includes providing an independent antenna tuning circuit and tuning element. In this case, the method 80 includes the further step of adapting the antenna element in response to at least one of the group of the counterpoise conductor tuning, antenna efficiency, user proximity, RF currents and an external RF environment. Optionally, this includes providing an independent monitoring system and impedance matching system for the antenna element, for controlling of the antenna element tuning. Optionally, the method 80 can include a further step of using the proximity sensor input to set maximum power limits for the communication device. In another option, the method 80 can include a further step of using the current sensor input to detect and control maximum power limits for the communication device. These options are optimized to maximize antenna radiating efficiency while limiting SAR.

In operation, the communication device utilizing the present invention first sets the power level to a standard level upon initiation, such as for connecting to a call or page. A self-test would evaluate the condition of all proximity and current sensors. If the self-test determines a failure in the sensor system, the adaptive tuning system of the present invention would be suspended for the remainder of the call, and the user can be alerted to a possible sensor failure. In this scenario, transmit power is set to standard power. Alternate embodiments of this system may contain more complex decision processes for alerting the user. Counters to avoid alerting the user for a false or temporary self-test failure could be incorporated. In other words, a counter could be included to allow multiple self-tests before resetting the power level. Maintenance data on recent failures could also be stored in the controller. Alternative embodiments could also optimize only the antenna at the standard power mode after a failure in the proximity or current sensors, making counterpoise tuning unreliable. It should be realized that many other power control techniques may be applied along these lines.

In the case of a successful self-test with no sensor failures, proximity sensor data is obtained and optionally checked for validity. This sensor data is then used to determine the position as detailed in FIG. 7. In the preferred embodiment, invalid proximity sensor data or the inability to determine the position mode will terminate the tuning sequence and set the power level to standard power. Given a valid position and sensor data, the present invention optimizes counterpoise tuning to minimize surface current distributions designated by the position mode selected. Counterpoise optimization begins with the retrieval of data from the current sensors. After the current sensor data is validated, the processor utilizes the current sensor data to drive the counterpoise tuning circuit. This process is iterated until the current density on the selected area of the phone is reduced below a threshold level or until the processor determines that counterpoise tuning is not converging and declares a failure, wherein power is set to a standard power.

Optionally, given a valid position and sensor data, the present invention optimizes antenna tuning by driving the antenna tuning and matching circuits to minimize VSWR. Data from the VSWR Monitor is first validated. Next, tuning iterations are performed on the antenna tuning and matching circuits until sensor data indicate that antenna efficiency is acceptable. In the event of invalid data or a convergence failure, the power is set to a standard power. In the event that tuning of the counterpoise and antenna are successful, the transmit power level of the communication device is set according to FIG. 7.

The actual tuning ranges and component values of the counterpoise tuning circuit depend entirely on the operating frequency of the device, the size and shape of conductive elements such as printed circuit boards and the battery and all the other conductors and is best determined experimentally. Typically, the counterpoise will have an effective electrical length that is near to a quarter-wavelength of the operating frequency, given an allowance of available tuning range of the tuning circuit. The tuning circuit provides a combination of a high impedance to the ground connection and a low impedance to the counterpoise to cause most of the antenna counterpoise current to flow on the counterpoise rather than to the ground. As far as the counterpoise is concerned, it is decoupled from the rest of the phone so that from a radiation point of view its electrical length can be independently set to an optimum such that the antenna counterpoise currents preferentially flow on it instead of near a user. The main tuning goal is to adjust the resonant frequency of the counterpoise to minimize the electromagnetic field at a surface portion of the housing. This leads to increased radiation efficiency.

In summary, it should be recognized that the present invention is a radiotelephone chassis-improvement and antenna/counterpoise control technique that optimizes a radiotelephone's transmit efficiency to allow for a higher effective radiating power. It can also reduce current draw and extend battery life by allowing the power amplifier of the radiotelephone to operate at a lower power step. As such, its benefits apply to any sort of antenna element or exciter. Although a typical helical monopole example is given, the invention is equally applicable to other antenna structures like printed wire antennas or planar inverted F antennas (PIFAs) as are known in the art.

It is to be understood that the phraseology or terminology employed herein is for the purpose of description and not of limitation. Accordingly, the invention is intended to embrace all such alternatives, modifications, equivalents and variations as fall within the broad scope of the appended claims.

What is claimed is:

1. An adaptive antenna system for a communication device having a transceiver disposed within a housing, the system comprising:

an antenna being electrically coupled to the transceiver;

at least one conductor counterpoise to the antenna, the at least one counterpoise conductor being contained within the housing and located distally from such surfaces of the housing that can be held by or placed in proximity to a user;

a second conductor coupled to a ground connection of the antenna and being contained within the housing;

a tuning circuit coupled between the at least one counterpoise conductor and the second conductor, the tuning circuit is operable to adapt the resonant frequency of the at least one counterpoise conductor to attract operational RF currents onto the at least one counterpoise conductor and divest operational RF currents away from the second conductor; and a controller, the controller controlling the operation of the tuning circuit in response to inputs indicating the proximity of the user.

2. The system of claim 1, wherein the housing is a conductive ground plane and constitutes the second conductor such that the tuning circuit adapts the counterpoise conductor to draw RF currents away from the housing and subsequently the user.

3. The system of claim 1, wherein the tuning circuit adapts the resonant frequency of the counterpoise conductor in response to detuning effects caused by location of the device in proximity to the user.

4. The system of claim 1, further comprising a plurality of proximity sensors disposed on the housing, the proximity sensors are operable to detect a proximity of the device to external objects and provide a signal for the tuning circuit to direct currents away from that portion of the second conductor near the activated proximity sensors.

5. The system of claim 1, wherein the antenna is tunable in response to at least one of the group of the counterpoise conductor tuning, antenna efficiency, user proximity, RF currents and an external RF environment.

6. The system of claim 1, further comprising at least one current sensor disposed in proximity to the second conductor, the at least one current sensor is operable to detect current in the second conductor and provide a signal for the tuning circuit to direct the detected current away from the second conductor.

7. An adaptive antenna system for a communication device having a transceiver disposed within a conductive housing, the system comprising:

an antenna being electrically coupled to the transceiver, the housing forming a ground plane for the antenna;

at least one conductor counterpoise to the antenna, the at least one counterpoise conductor being contained within the housing and located distally from such surfaces of the housing that can be held by or placed in proximity to a user;

a tuning circuit coupled between the at least one counterpoise conductor and the housing; and a controller for controlling the operation of the tuning circuit in response to inputs indicating the proximity of the device to external objects that detune the at least one counterpoise conductor, the controller directs the tuning circuit to adapt the resonant frequency of the at least one counterpoise conductor to attract operational RF currents onto the at least one counterpoise conductor and divert operational RF currents away from the housing.

8. The system of claim 7, further comprising a plurality of proximity sensors disposed on the housing, the proximity sensors are operable to detect a proximity of the device to external objects and provide a signal to the controller to direct the tuning circuit to provide coarse tuning to draw currents away from that portion of the second conductor near the activated proximity sensors onto the at least one counterpoise conductor.

9. The system of claim 7, further comprising at least one current sensor disposed in proximity to a ground plane of the device, the at least one current sensor is operable to detect current in the ground plane and provide a signal to the controller to direct the tuning circuit to provide fine tuning to draw the detected current away from the housing onto the at least one counterpoise conductor.

10. The system of claim 7, further comprising at least one current sensor disposed in proximity to the at least one counterpoise conductor, the at least one current sensor is operable to detect current in the counterpoise and provide a signal to the controller to confirm currents drawn away from the housing onto the at least one counterpoise conductor.

11. The system of claim 7, further comprising a VSWR monitor and matching circuit coupled to the antenna and the controller wherein the processor monitors VSWR of the antenna and controls the matching circuit to provide optimal antenna efficiency.

12. The system of claim 7, wherein a plurality of counterpoise conductors are contained within the housing with a portion of the tuning circuit between each of the counterpoise conductors and the ground plane, and further comprising a proximity sensor grid disposed on the housing, wherein the proximity sensor grid is operable to detect a proximity of the device to external objects and provide a signal to the controller to direct the tuning circuit to provide tuning to draw currents away from that portion of the ground plane located near the activated proximity sensors onto the counterpoise conductor located most distally from the activated proximity sensors.

13. A method for antenna counterpoise tuning in a communication device with a housing, the method comprising the steps of:

providing at least one conductor counterpoise to the antenna, a second conductor contained within the housing, a tuning circuit coupled between the counterpoise conductor and the second conductor, and a controller to control the operation of the tuning step in response to inputs from the monitoring step;

monitoring a detuning of the counterpoise conductor; and tuning the at least one counterpoise conductor to resonance to effect:

an attracting of RF currents onto the at least one counterpoise conductor, and a diverting of RF currents away from the second conductor.

14. The method of claim 13, wherein in the providing step the housing is a conductive ground plane and constitutes the second conductor and the at least one counterpoise conductor is internal to the housing such that the tuning step adapts the counterpoise conductor to draw RF currents away from the housing and subsequently a user.

15. The method of claim 13, wherein the monitoring step includes monitoring of the a least one counterpoise conductor in response to detuning effects caused by location of the device in proximity to an external object.

16. The method of claim 13, wherein the providing step includes providing a plurality of proximity sensors disposed on the housing, and wherein the monitoring step includes the proximity sensors detecting a proximity of the device to external objects and providing a signal for the tuning step to direct currents away from that portion of the second conductor near the activated proximity sensors.

17. The method of claim 13, wherein the providing step includes providing an antenna tuning circuit, and further comprising the step of adapting the antenna in response to at least one of the group of the counterpoise conductor tuning, antenna efficiency, user proximity, RF currents and an external RF environment.

18. The method of claim 13, wherein the providing step includes providing at least one current sensor disposed in proximity to the second conductor, and the monitoring step includes the at least one current sensor detecting current in the second conductor and outputting a signal for the tuning stop to direct the detected current away from the second conductor.

19. The method of claim 16, further comprising the step of using an input of at least one of the proximity sensors to set maximum power limits for the communication device.

20. The method of claim 18, further comprising the step of using an input of at least one of the current sensors to detect and control maximum power limits for the communication device.

* * * * *